US008746404B2

(12) United States Patent
Allam

(10) Patent No.: US 8,746,404 B2
(45) Date of Patent: Jun. 10, 2014

(54) GAS TURBINE ENGINE SYSTEMS AND METHODS INVOLVING OIL FLOW MANAGEMENT

(75) Inventor: Mahdy A. Allam, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 1074 days.

(21) Appl. No.: 12/182,265

(22) Filed: Jul. 30, 2008

(65) Prior Publication Data

US 2010/0025158 A1 Feb. 4, 2010

(51) Int. Cl.
*F01D 25/18* (2006.01)
*F01M 9/00* (2006.01)

(52) U.S. Cl.
USPC ..... 184/6.11; 184/1.5; 184/5.1; 184/6.2; 184/6.3; 184/6.4; 184/11.2; 184/55.1; 60/39.08; 60/605.1; 60/605.3; 60/786; 60/788

(58) Field of Classification Search
USPC ..... 184/6.11, 6.4, 55.1, 6.2, 6.3, 6.23, 6.28; 60/39.08; 137/85, 101, 596.15, 596.16
See application file for complete search history.

(56) References Cited

U.S. PATENT DOCUMENTS

| | | | | |
|---|---|---|---|---|
| 3,045,420 | A * | 7/1962 | Addie et al. | 60/605.3 |
| 4,932,501 | A | 6/1990 | Decker | |
| 5,042,616 | A * | 8/1991 | McHugh | 184/6.11 |
| 5,067,454 | A | 11/1991 | Waddington et al. | |
| 5,110,257 | A | 5/1992 | Hibner et al. | |
| 5,813,214 | A | 9/1998 | Moniz et al. | |
| 6,409,464 | B1 | 6/2002 | Fisher et al. | |
| 6,463,819 | B1 | 10/2002 | Rago | |
| 6,877,950 | B2 | 4/2005 | Liu | |
| 6,893,208 | B2 | 5/2005 | Frosini et al. | |
| 7,216,473 | B1 | 5/2007 | McArthur et al. | |
| 7,287,368 | B2 | 10/2007 | Tumelty et al. | |
| 2001/0047647 | A1 * | 12/2001 | Cornet | 60/39.02 |
| 2002/0037226 | A1 * | 3/2002 | Vogel | 417/407 |
| 2006/0054406 | A1 * | 3/2006 | Delaloye | 184/6.11 |
| 2006/0081419 | A1 * | 4/2006 | Care et al. | 184/6.11 |
| 2006/0207254 | A1 * | 9/2006 | Labala | 60/605.3 |

* cited by examiner

*Primary Examiner* — Robert A Siconolfi

*Assistant Examiner* — San Aung

(74) *Attorney, Agent, or Firm* — Carlson, Gaskey & Olds P.C.

(57) ABSTRACT

Gas turbine engines systems and methods involving oil flow management are provided. In this regard, a oil pressure analysis system for a gas turbine engine is operative to: receive information corresponding to measured oil pressure and rotational speed during a start up of the engine; correlate the information into data sets, each of the data sets containing a measured oil pressure and a corresponding rotational speed; and determine whether the oil flow valve is functioning properly based on the information contained in the data sets.

12 Claims, 3 Drawing Sheets

GAS TURBINE ENGINE SYSTEMS AND METHODS INVOLVING OIL FLOW MANAGEMENT

STATEMENT REGARDING FEDERALLY SPONSORED RESEARCH AND DEVELOPMENT

The U.S. Government may have an interest in the subject matter of this disclosure as provided for by the terms of contract number N-00019-02-C-3003 awarded by the United States Navy.

BACKGROUND

1. Technical Field

The disclosure generally relates to gas turbine engines.

2. Description of the Related Art

Gas turbine engines include numerous rotating components that require lubrication. In this regard, many gas turbine engines use oil to lubricate rotating components such as bearings. In addition to reducing friction and associated wear, the oil can be used to extract heat from the components.

SUMMARY

Gas turbine engines systems and methods involving oil flow management are provided. In this regard, an exemplary embodiment of a gas turbine engine system comprises: an oil system operative to direct lubricating oil, the oil system having an oil flow valve having an inlet, a first outlet and a second outlet; the oil flow valve being operative in a first position, in which oil provided to the inlet is directed to the first outlet, and a second position, in which oil is directed to the first outlet and the second outlet; and an oil pressure analysis system operative to receive information corresponding to a measured oil pressure and determine whether the oil pressure corresponds to a desired position of the oil flow valve.

An exemplary embodiment of an oil pressure analysis system for a gas turbine engine is operative to: receive information corresponding to measured oil pressure and rotational speed during a start up of the engine; correlate the information into data sets, each of the data sets containing a measured oil pressure and a corresponding rotational speed; and determine whether the oil flow valve is functioning properly based on the information contained in the data sets.

An exemplary embodiment of a gas turbine engine comprises: a compressor; a turbine operative to drive the compressor, the turbine having a shaft interconnected with the compressor; a first bearing operative to support the shaft; an oil system having an oil flow valve operative to lubricate the bearing with oil; and an oil pressure analysis system operative to: receive information corresponding to detected oil pressures and rotational speeds during start up of the engine; correlate the information into data sets, each of the data sets containing a detected oil pressure and a corresponding rotational speed; and determine whether the oil flow valve is functioning properly based on the information contained in the data sets.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Gas turbine engines systems and methods involving oil flow management are provided, several exemplary embodiments of which will be described in detail. In this regard, oil flow management of gas turbine engines can facilitate lubrication and cooling of components. In some embodiments, oil can be selectively directed to one or more bearings to lessen an effect known as a bowed start, during which a shaft of the engine deflects or bows downwardly prior to rotation beginning during start-up. By providing additional oil to an intermediately located bearing that supports the shaft, the oil may tend to reduce the bow, thereby reducing a potential for the engine to become damaged during start-up. In some embodiments, an oil flow valve is used to direct the oil, with various positions of the valve being used depending upon the rotational speed of the engine.

Figure 1:
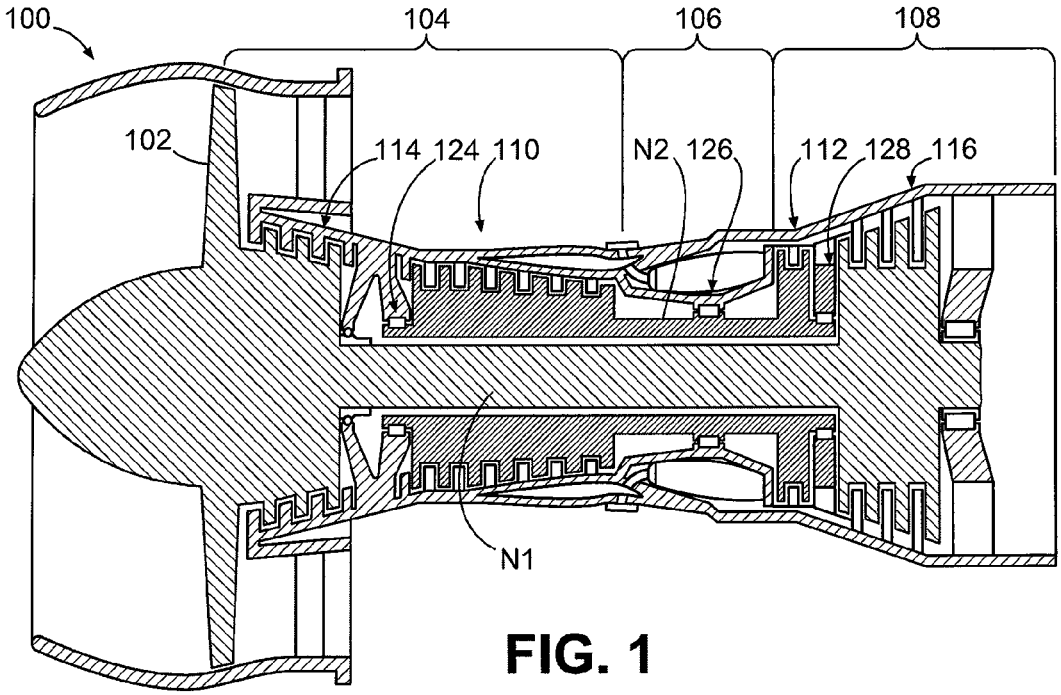
FIG. 1 is a schematic diagram depicting an exemplary embodiment of a gas turbine engine.

Referring now in greater detail to the drawings, FIG. 1 depicts an exemplary embodiment of a gas turbine engine. As shown in FIG. 1, engine 100 is depicted as a turbofan that incorporates a fan 102, a compressor section 104, a combustion section 106 and a turbine section 108. Additionally, engine 100 includes a high pressure shaft (N2) that interconnects a high pressure compressor 110 and a high pressure turbine 112, and a low pressure shaft (N1) that interconnects a low pressure compressor 114 and a low pressure turbine 116. Although depicted as a turbofan gas turbine engine, it should be understood that the concepts described herein are not limited to use with turbofans, as the teachings may be applied to other types of gas turbine engines.

Figure 2:
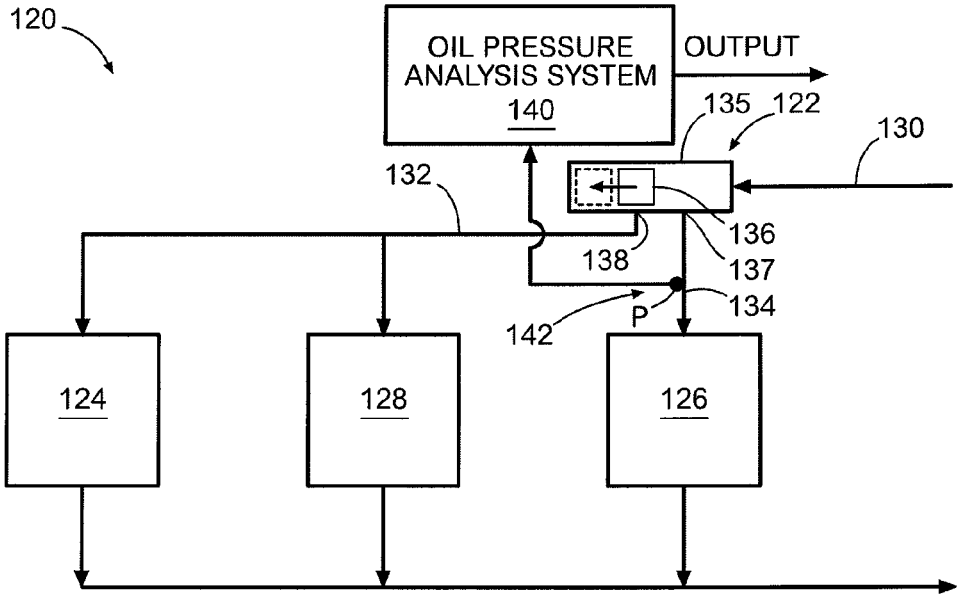
FIG. 2 is a schematic diagram depicting an exemplary embodiment of a gas turbine engine system involving oil flow management.

FIG. 2 is a schematic diagram depicting a gas turbine engine system involving oil flow management that is associated with engine 100. In particular, system 120 includes an oil flow valve 122 that is used to direct oil selectively to bearings 124, 126 and 128. Inlet conduit 130 provides oil to valve 122 and outlet conduits 132, 134 route oil from the valve.

Although various configurations of oil flow valves can be used, the embodiment of FIG. 2 includes a housing 135 that surrounds a piston 136. The piston is movable between a first position, in which oil provided to the valve is directed out of outlet 137, and a second position (depicted in dashed lines), in which oil provided to the valve is additionally directed out of outlet 138.

Additionally, an oil pressure analysis system 140 is provided that receives information from an oil pressure sensor 142. In this embodiment, pressure sensor 142 is positioned to sense oil pressure in oil conduit 134.

In operation, such as during start-up of engine 100, valve 122 exhibits the first position. In the first position, oil is routed to bearing 126. Notably, bearing 126 is an intermediately located bearing of shaft N2. As such, oil provided to shaft N2 during start-up may reduce the likelihood and/or severity of a bowed start. However, as rotational speed of the shafts increases, additional oil should be provided to other bearings (e.g., bearings 124, 128).

In this regard, based on one or more of potentially several parameters, oil flow valve 122 is adjusted to the second position, thereby routing oil to all of the bearings. However, if valve 122 should fail to achieve the second position, damage may be caused to the engine as a proper amount of oil may not be delivered to all of the bearings.

Figure 3:
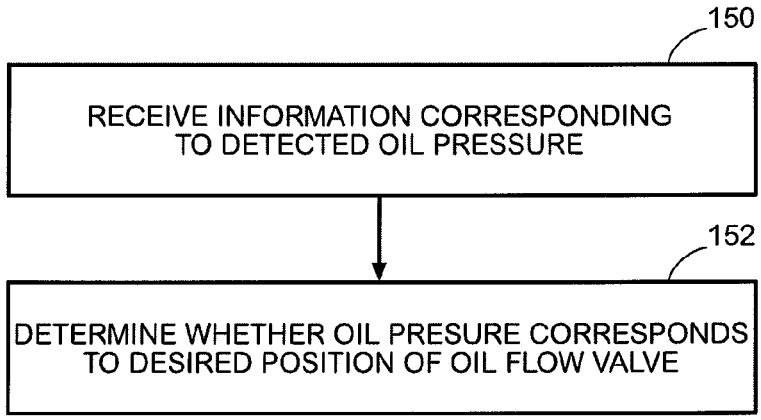
FIG. 3 is a flowchart depicting functionality of an exemplary embodiment of a method involving oil flow management.

FIG. 3 is a flowchart depicting functionality of an exemplary embodiment of a method involving oil flow management, such as the functionality that may be performed by the oil pressure analysis system 140 of FIG. 2. As shown in FIG. 3, the functionality (or method) may be construed as beginning at block 150, in which information corresponding to a detected oil pressure is received. In block 152, a determination is made as to whether the detected oil pressure corresponds to a desired position of the oil flow valve. It should be noted that oil pressure generally tends to increase responsive to an increase in rotational speed of shafts of a gas turbine engine as oil pumps that pressurize the oil system tend to be driven from an accessory gear pad that include components that engage and rotate with one or more of the shafts.

Figure 4:
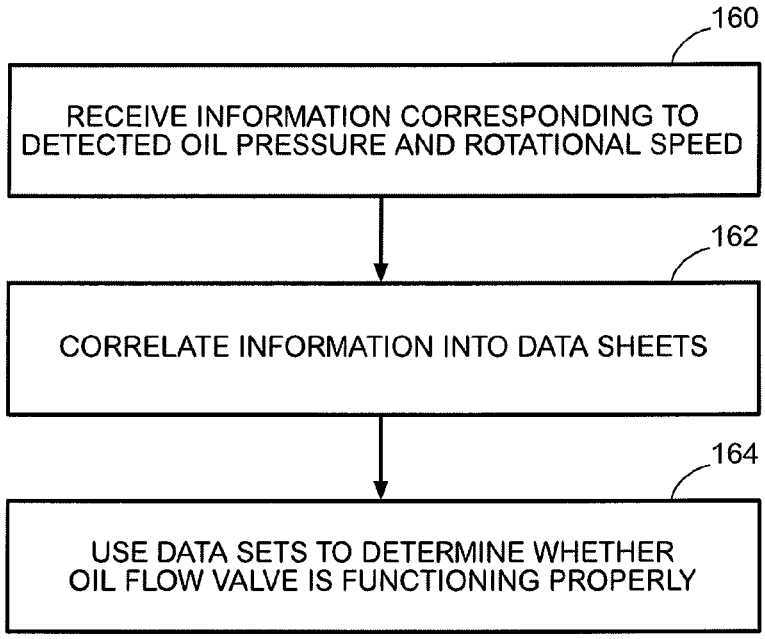
FIG. 4 is a flowchart depicting functionality of another exemplary embodiment of a method involving oil flow management.

FIG. 4 is a flowchart depicting functionality of another exemplary embodiment of a method involving oil flow management. As shown in FIG. 4, the functionality (or method) may be construed as beginning at block 160, in which information corresponding to detected oil pressures and rotational speeds during a start up of the engine is received. In block 162, the information is correlated into data sets, with each of the data sets containing a measured oil pressure and a corresponding rotational speed. By way of example, the rotational speed can correspond to the speed (rpm) of rotation of a shaft (e.g., shaft N2) of the engine. In block 164, a determination is made as to whether the oil flow valve is functioning properly based on the information contained in the data sets. In some embodiments, this can be accomplished by analyzing sequential subsets of the data sets. By way of example, in some embodiments, if any but the last data set in sequence of a subset of the data sets exhibits a maximum measured pressure of the oil, a determination can be made that the oil flow valve is exhibiting the second position.

Figure 5:
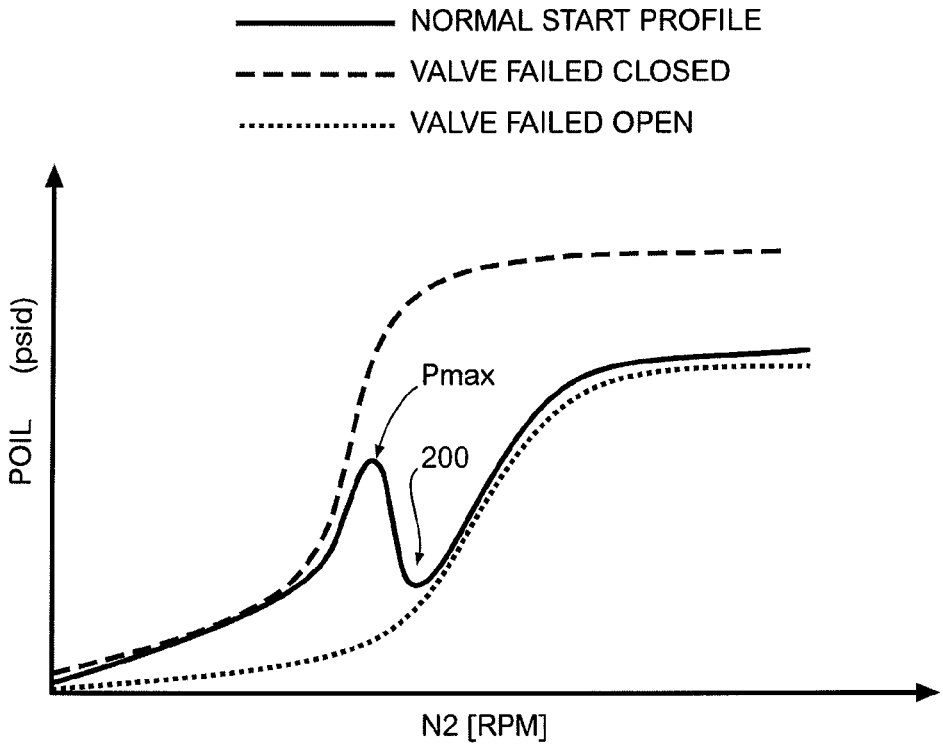
FIG. 5 is a graph depicting oil pressure versus rotational speed during various modes of operation of an embodiment of an oil flow valve.

FIG. 5 is a graph depicting oil pressure versus rotational speed during various modes of operation of an embodiment of an oil flow valve. As shown in FIG. 5, during a normal start profile (solid line) in which the valve is initially in the first position and then adjusted to the second position as rotational speed reaches a predetermined value, oil pressure increases to a local maximum (Pmax) while the valve is in the first position. The oil pressure then drops as the valve moves to the second position and routes oil to other components. At some point (depicted in FIG. 5 as a trough 200), the increase in oil pressure attributable to the increase in rotational speed of the engine compensates for the routing of the oil to multiple components, thereby enabling the oil pressure to increase toward steady state operating pressures.

In contrast, the long dashed lines in FIG. 5 depict pressure versus rotational speed when the valve fails to move to the second position. In such a failure mode, oil is not routed to other components regardless of the rotational speed of the engine. Unfortunately, this mode can lead to a lack of required oil to those other components.

The short dashed lines of FIG. 5 depict pressure versus rotational speed when the valve fails open. In such a failure mode, oil is routed to multiple components during start, even when rotational speed is low. This can result inadequately pressurized oil being delivered to one or more bearings, thereby allowing a bowed start to take place.

Figure 6:
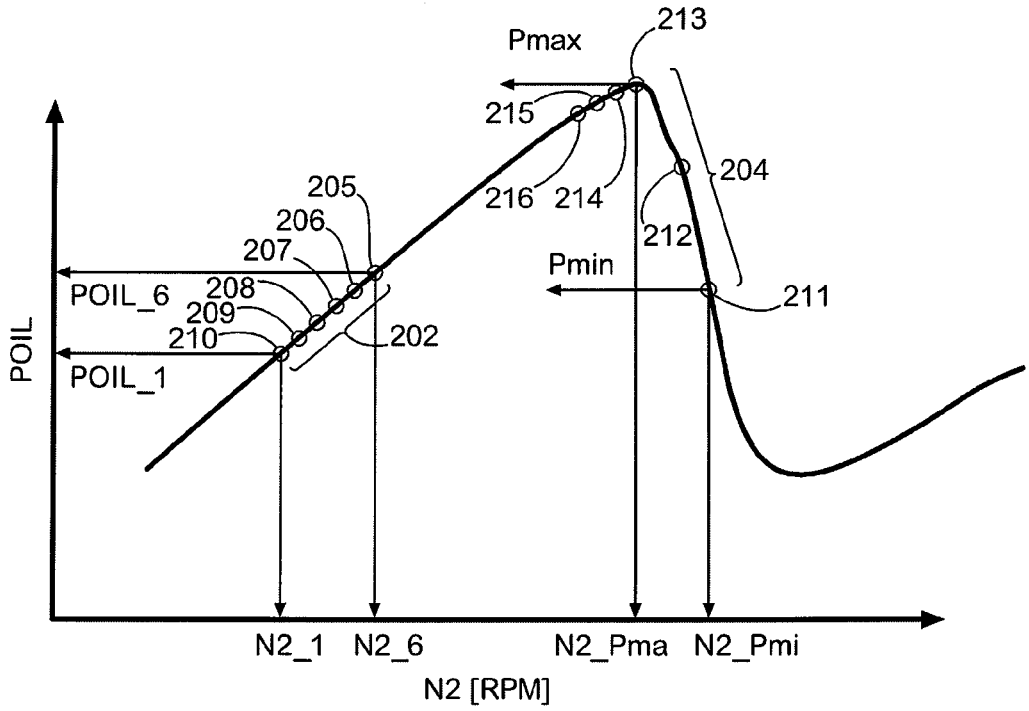
FIG. 6 is a graph depicting oil pressure versus rotational speed in which data subsets are analyzed.

In order to identify failure modes of operation, an oil pressure analysis system may be configured to determine whether the oil flow valve is functioning properly by analyzing sequential subsets of oil pressure and rotational speed data sets. By way of example, in some embodiments, each of the sequential subsets can contain six data sets. FIG. 6 graphically depicts analysis of data sets by such an embodiment.

As shown in FIG. 6, two subsets 202, 204 are depicted, with subset 202 representing an earlier subset in the sequence of data sets. Subset 202 includes six data sets, of which set 205 is first in the subset, sets 206, 207, 208 and 209 are intermediate sets, and set 210 is a the last of the sets. Subset 204 includes six data sets, of which set 211 is first in the subset, sets 212, 213, 214 and 215 are intermediate sets, and set 216 is a the last of the sets.

In this embodiment, the data sets are populated by recording information corresponding to the detected oil pressure POIL (as provided by sensor 142, for example) and engine speed (e.g., N2 speed) at predetermined intervals (e.g., every 0.15 seconds). In FIG. 6, POIL_6 and N2_6 are current values while POIL_1, 2, 3, 4 and 5, and N2_1, 2, 3, 4 and 5 are previous sequential values. As information corresponding to a next current data set is received, the system drops the oldest value of the subset, thereby consistently maintaining six data sets for analysis. That is, the six most recent values available at any given time are used. Using the data sets, the system calculates minimum POIL (PMIN) and maximum POIL (PMAX), as well as the corresponding rotational speeds of N2 (i.e., N2_PMIN and N2_PMAX, respectively). The system can also calculate the following:

$$DELTA_P = PMAX - PMIN; \text{ and}$$

$$DELTA_N2 = 100*(N2_PMIN - N2_PMAX)/N2_PMIN$$

In this embodiment, the system determines that the oil flow valve is open if the following three conditions are met: 1) PMAX is exhibited by any data set of a subset except for the last (in this case, sixth data set); 2) DELTA_P is greater than or equal to a threshold oil pressure (e.g., 20 PSI); and DELTA_N2 is greater than or equal to a nominal rotational speed (e.g., −0.05%).

Typically, once the oil flow valve is opened during a start-up, that valve should remain in the second position until engine shut-down, for example. In order to ensure such operation, a flag can be set to 'ON'. This flag can be used to ensure that the check for proper functioning of the oil flow valve is not done if engine speed is reduced intentionally to sub-idle conditions and ramped back up again after the valve moves properly to the second position during start-up. In some embodiments, the oil flow valve remains in the second position (and the associated flag can stay 'ON') following engine start and the rest of the mission until, for example, immediately before engine shut down. For instance, in some embodiments, the valve may be controlled to move to the first position responsive to the engine speed dropping below approximately 3000 RPM.

Various functionality, such as that described above in the flowcharts, can be implemented in hardware and/or software. In this regard, a computing device can be used to implement various functionality, such as that depicted in FIGS. 3 and 4, that may be facilitated by an oil pressure analysis system.

In terms of hardware architecture, such a computing device can include a processor, memory, and one or more input and/or output (I/O) device interface(s) that are communicatively coupled via a local interface. The local interface can include, for example but not limited to, one or more buses and/or other wired or wireless connections. The local interface may have additional elements, which are omitted for simplicity, such as controllers, buffers (caches), drivers, repeaters, and receivers to enable communications. Further, the local interface may include address, control, and/or data connections to enable appropriate communications among the aforementioned components.

The processor may be a hardware device for executing software, particularly software stored in memory. The processor can be a custom made or commercially available processor, a central processing unit (CPU), an auxiliary processor among several processors associated with the computing device, a semiconductor based microprocessor (in the form of a microchip or chip set) or generally any device for executing software instructions.

The memory can include any one or combination of volatile memory elements (e.g., random access memory (RAM, such as DRAM, SRAM, SDRAM, VRAM, etc.)) and/or nonvolatile memory elements (e.g., ROM, hard drive, tape, CD-ROM, etc.). Moreover, the memory may incorporate electronic, magnetic, optical, and/or other types of storage media. Note that the memory can also have a distributed architecture, where various components are situated remotely from one another, but can be accessed by the processor.

The software in the memory may include one or more separate programs, each of which includes an ordered listing of executable instructions for implementing logical functions. A system component embodied as software may also be construed as a source program, executable program (object code), script, or any other entity comprising a set of instructions to be performed. When constructed as a source program, the program is translated via a compiler, assembler, interpreter, or the like, which may or may not be included within the memory.

The Input/Output devices that may be coupled to system I/O Interface(s) may include input devices, for example but not limited to, a keyboard, mouse, scanner, microphone, camera, proximity device, etc. Further, the Input/Output devices may also include output devices, for example but not limited to, a printer, display, etc. Finally, the Input/Output devices may further include devices that communicate both as inputs and outputs, for instance but not limited to, a modulator/demodulator (modem; for accessing another device, system, or network), a radio frequency (RF) or other transceiver, a telephonic interface, a bridge, a router, etc.

When the computing device is in operation, the processor can be configured to execute software stored within the memory, to communicate data to and from the memory, and to generally control operations of the computing device pursuant to the software. Software in memory, in whole or in part, is read by the processor, perhaps buffered within the processor, and then executed.

One should note that the flowcharts included herein show the architecture, functionality, and operation of a possible implementation of software. In this regard, each block can be interpreted to represent a module, segment, or portion of code, which comprises one or more executable instructions for implementing the specified logical function(s). It should also be noted that in some alternative implementations, the functions noted in the blocks may occur out of the order and/or not at all. For example, two blocks shown in succession may in fact be executed substantially concurrently or the blocks may sometimes be executed in the reverse order, depending upon the functionality involved.

One should note that any of the functionality described herein can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" contains, stores, communicates, propagates and/or transports the program for use by or in connection with the instruction execution system, apparatus, or device. The computer readable medium can be, for example but not limited to, an electronic, magnetic, optical, electromagnetic, infrared, or semiconductor system, apparatus, or device. More specific examples (a nonexhaustive list) of a computer-readable medium include a portable computer diskette (magnetic), a random access memory (RAM) (electronic), a read-only memory (ROM) (electronic), an erasable programmable read-only memory (EPROM or Flash memory) (electronic), and a portable compact disc read-only memory (CDROM) (optical).

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. An oil pressure analysis system for a gas turbine engine, the oil pressure analysis system having an oil flow valve and a pressure sensor located to detect the pressure of the oil downstream of the oil flow valve, the oil pressure analysis system being operative to:

receive information corresponding to measured oil pressure and rotational speed during a start up of the engine;

correlate the information into a first data subset and a second data subset, each of the data subsets contain a multiple of data sets in which each data set includes a measured oil pressure and a corresponding rotational speed, the second data subset separated from the first data subset by rotational speed;

calculate a minimum detected oil pressure (PMIN) and maximum detected oil pressure (PMAX) with a corresponding rotational speed based on the information contained in the data sets; and determine whether the oil flow valve is functioning properly.

2. The system of claim 1, wherein the oil pressure analysis system is operative to determine whether the oil flow valve is functioning properly by analyzing sequential subsets of the data sets.

3. The system of claim 2, wherein each of the sequential data subsets contains six data sets.

4. The system of claim 1, wherein, responsive to determining that the oil flow valve is not functioning properly, the oil pressure analysis system provides a notification to a cockpit of an aircraft in which the system is installed.

5. A gas turbine engine comprising:

a compressor;

a turbine operative to drive the compressor, the turbine having a shaft interconnected with the compressor;

a first bearing operative to support the shaft;

an oil system having an oil flow valve operative to lubricate the bearing with oil; and an oil pressure analysis system having a pressure sensor located to detect the pressure of the oil downstream of the oil flow valve, the oil pressure analysis system operative to:

receive information corresponding to detected oil pressures and rotational speeds during start up of the engine;

correlate the information into a first data subset and a second data subset, each of the data subsets contain a multiple of data sets in which each data set includes a measured oil pressure and a corresponding rotational speed, the second data subset separated from the first data subset by rotational speed;

calculate a minimum detected oil pressure (PMIN) and maximum detected oil pressure (PMAX) with a corresponding rotational speed based on the information contained in the data sets; and determine whether the oil flow valve is functioning properly.

6. The engine of claim 5, wherein:

the engine has a second bearing;

the oil flow valve is operative to exhibit a first position, such that oil provided to the oil flow valve is directed to the first bearing, until the rotational speed of the engine corresponds to a first rotational speed; and responsive to the first rotational speed, the oil flow valve is operative to exhibit a second position such that the oil provided to the oil flow valve is additionally directed to the second bearing.

7. The engine of claim 5, wherein:

the oil flow valve has an inlet, a first outlet and a second outlet; and in first position, the oil flow valve is operative to route oil via the first outlet and not the second outlet and, in the second position, the oil flow valve is operative to route oil via the first outlet and the second outlet.

8. The engine of claim 7, wherein the oil flow valve is operative to exhibit the first position during at least a portion of starting of the engine.

9. The engine of claim 7, wherein the oil flow valve is operative to exhibit the first position until the rotational speed of the engine corresponds to a first rotational speed exhibited by the engine during start.

10. The engine of claim 9, wherein the oil flow valve is operative to maintain the second position during operation after the start.

11. The engine of claim 7, wherein the engine is a turbofan gas turbine engine.

12. The system of claim 1, further comprising, calculating DELTA_P=PMAX−PMIN; DELTA_N2=100*(N2_PMIN−N2_PMAX)/N2_PMIN; and determine that the oil flow valve is open if the following three conditions are met:

1) PMAX is exhibited by any data set of a subset except for the last;

2) DELTA_P is greater than or equal to a threshold oil pressure; and

3) DELTA_N2 is greater than or equal to a nominal rotational speed.

* * * * *